US005775275A

United States Patent [19]

Philo

[11] Patent Number: 5,775,275

[45] Date of Patent: Jul. 7, 1998

[54] VALVE LIFTER

[75] Inventor: Charles Michael Philo, Hudsonville, Mich.

[73] Assignee: General Motors Corporation, Detroit, Mich.

[21] Appl. No.: 645,339

[22] Filed: May 13, 1996

Related U.S. Application Data

[63] Continuation-in-part of Ser. No. 517,483, Aug. 21, 1995, abandoned.

[51] Int. Cl.[6] ..... F01L 1/14

[52] U.S. Cl. ..... 123/90.5; 123/90.55; 74/569

[58] Field of Search ..... 123/90.27, 90.48, 123/90.5, 90.51, 90.55; 74/569; 251/336, 337

[56] References Cited

U.S. PATENT DOCUMENTS

| | | | |
|---|---|---|---|
| 4,335,685 | 6/1982 | Clouse | 123/90.5 |
| 5,178,107 | 1/1993 | Morel, Jr. et al. | 123/90.5 |
| 5,361,733 | 11/1994 | Spath et al. | 123/90.16 |
| 5,385,124 | 1/1995 | Hillebrand et al. | 123/90.5 |

FOREIGN PATENT DOCUMENTS

| | | | |
|---|---|---|---|
| 2215481 | 3/1972 | Germany . | |
| 2340074 | 2/1975 | Germany | 123/90.48 |

*Primary Examiner*—Weilun Lo
*Attorney, Agent, or Firm*—Karl F. Barr, Jr.

[57] ABSTRACT

A valve lifter has a cam follower body with a closed end, or head from which depends concentric inner and outer cylinder surfaces. The inner cylinder surface defines a hollow cylinder having a first, closed end and a second, open end configured to receive a hydraulic lash adjuster, for engagement with the valve of an internal combustion engine. Additionally the inner and outer cylinder surfaces define laterally spaced recesses therebetween for receiving cam engaging rollers supported on transverse shafts extending therein. The shafts are supported at their radially outer ends in openings in the outer cylinder surface and at inner radial ends by abutment with the inner cylinder surface. The cantilevered shafts are thus supported against bending under loads applied by the rollers through the fixing of outer ends in the openings and through frictional interaction of the inner radial ends of the shaft against the inner cylindrical surface of the follower.

1 Claim, 2 Drawing Sheets

VALVE LIFTER

This is a continuation-in-part of Ser. No. 08/517,483 filed on Aug. 21, 1995, now abandoned.

TECHNICAL FIELD

The invention relates to valve lifters for an internal combustion engine.

U.S. Pat. No. 5,273,005 issued in the name of Philo et al. discloses a roller valve lifter of the hydraulic lash adjusting type having a roller and shaft assembly received in the open, bottom end of the lifter body. The design, while effective, requires that the lifter include significant body length to accommodate the roller and shaft at its terminal end.

U.S. Pat. No. 5,361,733 discloses a roller valve direct acting hydraulic lifter having a design which minimizes lifter body length through the utilization of two, essentially side mounted roller and shaft assemblies which are placed adjacent to the hydraulic element as shown in FIG. 8 of the reference. This design limits minimum lifter diameter for support of each roller shaft end. Typically, in such dual roller designs, both ends of each roller shaft are received in openings in coaxial inner and outer walls of the lifter body. The walls supporting the shaft add to the diameter of the lifter as they require a substantial radial thickness to support the force imparted on the shaft through the roller and to facilitate fixing of the shaft through the use of a pin or other known means for restraint.

SUMMARY OF THE INVENTION

In a preferred embodiment of the invention, a roller hydraulic valve lifter includes a follower body carrying diametrically mounted shaft and roller assemblies. The body may include an outer cylindrical skirt and an inner, cylindrical skirt extending coaxial with the outer skirt and defining an annular space therebetween. The outer skirt includes an opening supporting one end of a roller shaft therein. The shaft extends radially inwardly towards the inner cylindrical skirt such that the inner end of the shaft is placed in abutment with a portion of the inner skirt. A roller is supported by the shaft, within the annular recess between the outer and the inner skirts. The cantilever shaft is effective to support the roller thereon.

Such cantilever shaft and roller assemblies are applicable to single and double roller lifter applications.

The present invention will now be described, by way of example, with reference to the accompanying drawings.

BRIEF DRAWING DESCRIPTION

DETAILED DESCRIPTION OF THE PREFERRED EMBODIMENT

Figure 1:
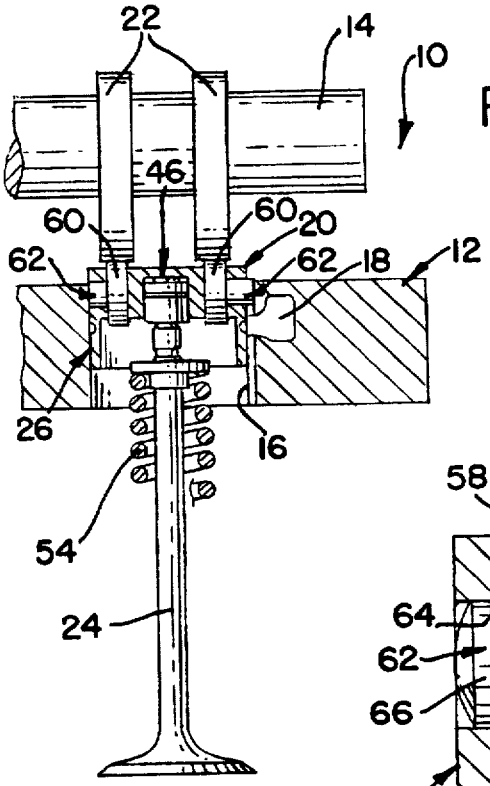
FIG. 1 is a partially schematic cross-sectional view of an engine having a valve lifter according to the present invention.
Figure 2:
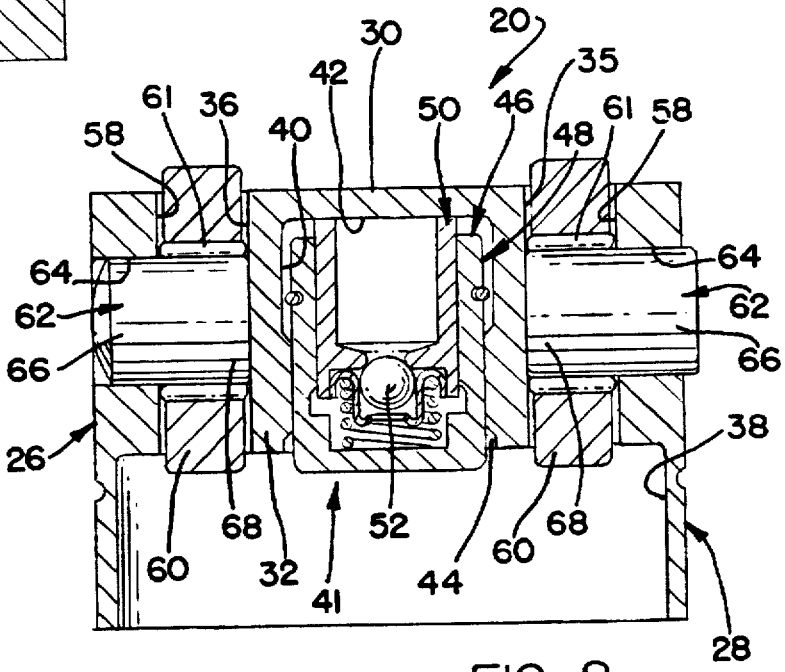
FIG. 2 is a cross-sectional view of a valve lifter according to the present invention.
Figure 3:
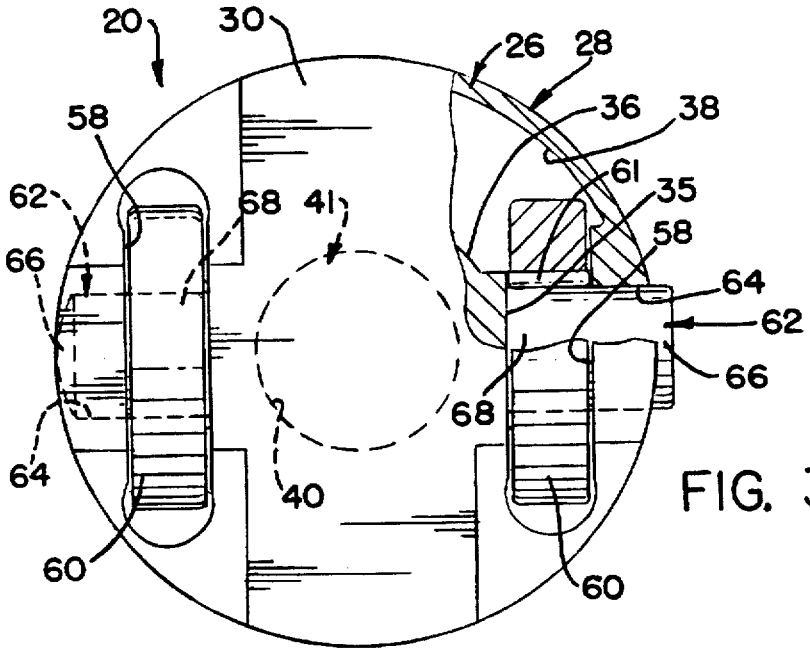
FIG. 3 is a top view of the lifter of FIG. 2, partially in section, showing relative locations of various parts.
Figure 4:
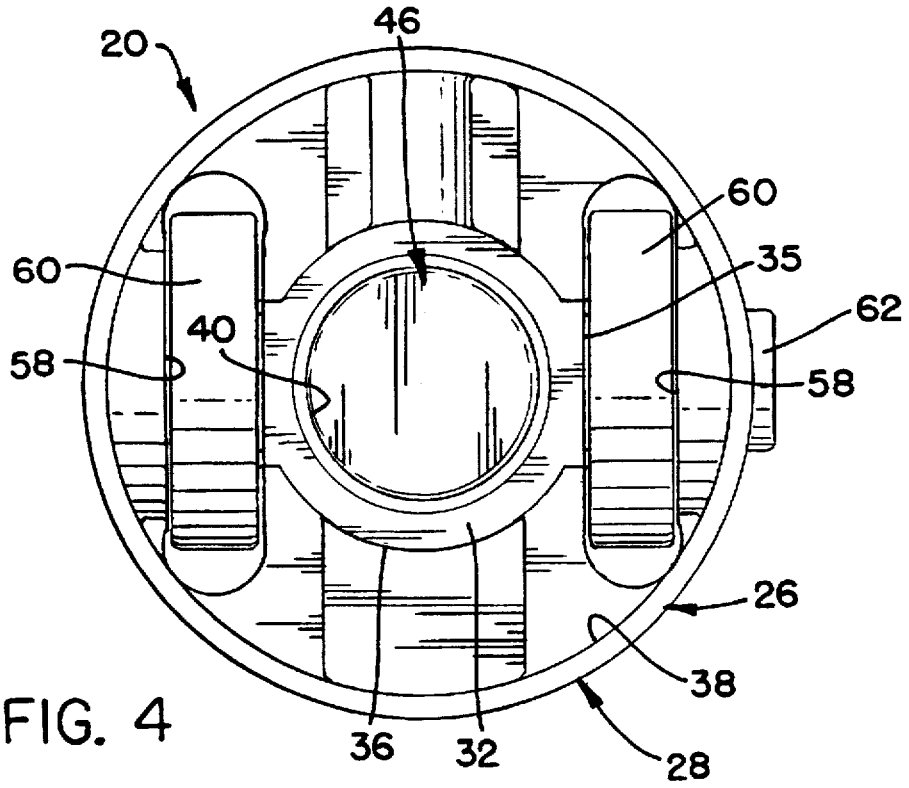
FIG. 4 is a bottom view of the lifter of FIG. 2, showing relative locations of various parts.
Figure 5:
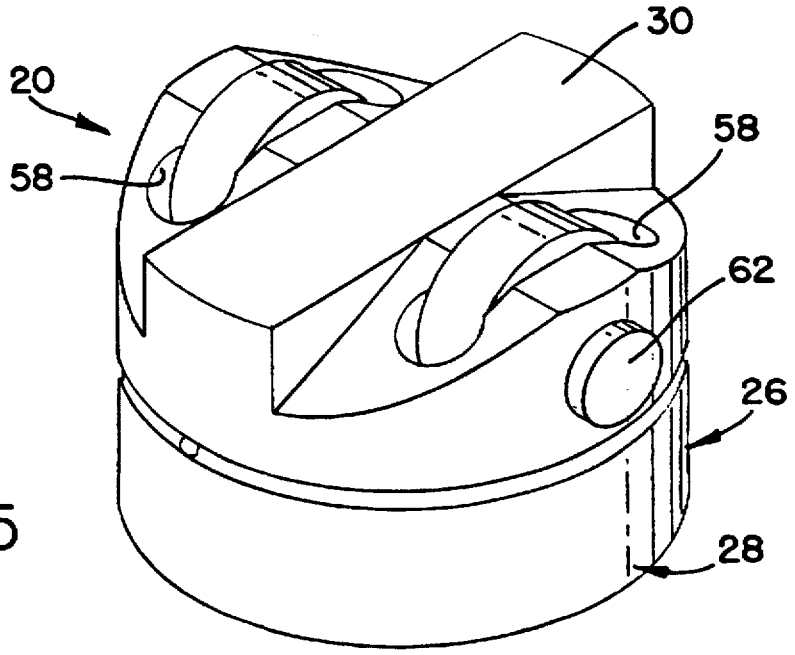
FIG. 5 is a perspective view of the lifter of FIG. 2.

Referring now to FIGS. 1–5 of the drawings, an engine 10 includes a head and/or carrier component 12 supporting a camshaft 14 and having a sleeve or bore 16 in communication with an oil pressure gallery 18 to thereby receive a plurality of roller direct acting hydraulic valve lifters 20, only one being shown. The camshaft includes cams 22, for each of the inlet and exhaust valves 24 of the engine 10. The cams 22 are configured to actuate the valves 24 over at least a portion of the lift curve of each valve.

The roller lifter 20 includes an annular follower body 26 having a cylindrical outer skirt 28, depending from an upper portion or head 30, that is reciprocable in bore 16 in the engine cam carrier 12. The upper head 30 also includes an inner cylindrical surface or skirt 32 spaced concentrically within the outer skirt 28. The inner skirt 32 includes an outer surface 36 which faces the inner surface 38 of the outer skirt 28, and an inner surface 40 which defines a hollow cylinder 41 having a closed end 42 and an open end 44.

Within the hollow cylinder 41 there is received a hydraulic lash adjuster or hydraulic element assembly (HEA) 46. This HEA may include a hollow piston 48 internally carrying a plunger 50 with a check valve 52 and other elements similar to conventional HEA'S.

The piston 48 of HEA 46 may directly engage the stem of the valve 24 for actuating it in an open direction. A valve spring 54 acting against the valve 24 and a fixed seat, not shown, in the engine 10 biases the valve 24 in a closing direction while similarly biasing the roller lifter 20 against the cams 22.

Between the inner and outer surfaces 38,36 of outer and inner skirts 28,32 are defined laterally spaced recesses or pockets 58 in which rollers 60 are located. The rollers engage the cams 22 and are rotatably carried by suitable bearings 61, supported on roller shafts 62 extending transversely across the recesses 58. The rollers 60 are effective to reduce the friction of the valve mechanism during operation on the cams 22. Transverse openings 64 in the outer skirt 28 receive the outer ends 66 of the roller shafts 62 while the inner ends 68 of the shafts 62 are placed in abutment against flattened portion 35 of the outer surface 36 of the inner cylindrical skirt 32. The outer ends 66 of the shafts 62 are fixed in position within the openings 64 using an interference fit between the shaft and the opening or through the use of another suitable method such as staking or pinning. The inner end 68 of each shaft 62 is in frictional contact with the skirt surface 36 and operates to resist bending forces acting on the cantilevered shaft 62 caused by the action of the cams 22 on the rollers 60. In circumstances of high anticipated shaft loading, a ceramic shaft may be desirable to avoid unwanted deflection due to ceramic's lower deflection rate over a similar steel shaft.

In operation, the cam 22 actuates the rollers 60 to move the valve lifter 20 and the valve 24 according to a preset lift curve. The arrangement provides a compact construction for a direct activating valve lifter having dual friction reducing rollers with the HEA located between the rollers. Application of the cantilever roller shaft of the present invention supports minimization of the valve lifter diameter by allowing a reduction in the required minimum thickness of the inner skirt 32, thereby eliminating the need to support the radially inner end of the roller shaft within an opening in the inner skirt. In addition, the manner of supporting the roller shaft, as described above, is applicable in cases in which the inner cylinder 41 is not readily accessible during the construction of the lifter, making location and fixing of the inner shaft end in an opening in the inner cylinder difficult.

While the invention has been described with reference to a hydraulic valve lifter having dual friction reducing rollers, it should be apparent to one of ordinary skill in the art that the invention has application to all roller hydraulic lifters in which it may be desirable to support a roller in the described manner.

I claim:

1. A valve lifter comprising a cam follower acted on by a cam, including a follower body with concentric inner and outer surfaces defining laterally spaced recesses therebetween for receiving cam engaging rollers therein, said rollers supported on transverse, cantilevered shafts extending across said recesses, said shafts supported at first, radially outer ends in openings in said outer surface of said follower body, and at inner radial ends by abutment against a flattened area of said inner surface to define a contact area and operable to resist bending forces imposed by the action of the cam on said rollers.

* * * * *